US006626596B2

(12) United States Patent
Hirabayashi et al.

(10) Patent No.: US 6,626,596 B2
(45) Date of Patent: Sep. 30, 2003

(54) WIDE FORMAT PRINTER WITH DETACHABLE AND REPLACEABLE PAPER FEED UNIT COMPONENTS

(75) Inventors: Hiromitsu Hirabayashi, Irvine, CA (US); Shinji Kanemitsu, Irvine, CA (US)

(73) Assignee: Canon Kabushiki Kaisha, Tokyo (JP)

( * ) Notice: Subject to any disclaimer, the term of this patent is extended or adjusted under 35 U.S.C. 154(b) by 54 days.

(21) Appl. No.: 09/886,085

(22) Filed: Jun. 22, 2001

(65) Prior Publication Data

US 2001/0036381 A1 Nov. 1, 2001

Related U.S. Application Data

(63) Continuation of application No. 09/019,190, filed on Feb. 5, 1998, now Pat. No. 6,325,560.

(51) Int. Cl.[7] ..... B41J 13/03; B41J 13/076

(52) U.S. Cl. ..... 400/636; 400/641; 400/634; 271/272; 271/314

(58) Field of Search ..... 400/579, 585, 400/585.1, 588, 608.1, 636, 636.2, 637, 637.6, 639, 625, 641; 271/272, 314

(56) References Cited

U.S. PATENT DOCUMENTS

| | | | | |
|---|---|---|---|---|
| 4,205,770 A | | 6/1980 | Wojdyla | 400/607 |
| 4,448,559 A | * | 5/1984 | Matsuda et al. | 400/637.4 |
| 4,692,778 A | | 9/1987 | Yoshimura et al. | 346/145 |
| 4,962,390 A | | 10/1990 | Yoshimura et al. | 346/140 |
| 5,090,827 A | | 2/1992 | Hirano et al. | 400/185 |
| 5,163,675 A | | 11/1992 | Sunohara | 400/636 |
| 5,188,029 A | | 2/1993 | Sugimoto et al. | 101/228 |
| 5,258,773 A | | 11/1993 | Arakawa et al. | 346/1.1 |
| 5,266,974 A | | 11/1993 | Koitabashi et al. | 346/140 |
| 5,416,395 A | | 5/1995 | Hiramatsu | 318/600 |
| 5,471,290 A | | 11/1995 | Nagayama et al. | 271/228 |

(List continued on next page.)

FOREIGN PATENT DOCUMENTS

| | | | | |
|---|---|---|---|---|
| JP | 60-183178 | | 9/1985 | |
| JP | 03193480 A | * | 8/1991 | B41J/29/17 |
| JP | 3-239572 | | 10/1991 | |
| JP | 5-270073 | | 10/1993 | |
| JP | 6-227700 | | 8/1994 | |
| JP | 7-52485 | | 2/1995 | |

OTHER PUBLICATIONS

Hewlett Packard HP LaserJet 5L Printer User's Manual, pp. 1–2, 4–2, 4–4 and 4–5, 1995.

(List continued on next page.)

*Primary Examiner*—Daniel J. Colilla
(74) *Attorney, Agent, or Firm*—Fitzpatrick, Cella, Harper & Scinto

(57) ABSTRACT

A wide-width format printer having detachable and replaceable paper feed unit components includes an automatic sheet feeder having a feeding width corresponding to standard width print media, a manual sheet feeder having a feeding width corresponding to standard width print media plus an additional width, paper feed unit for feeding print media fed from either the automatic sheet feeder or the manual sheet feeder through a paper path which passes a print position to a media ejection portion, the paper feed unit comprising at least first and second detachable print roller sections, first and second detachable spur wheel sections, at least two detachable friction wheels and a drive roller, wherein the first detachable print roller section and spur wheel section oppose each other, the second detachable print roller section and spur wheel section oppose each other and wherein the first and second detachable printer roller segments are aligned coaxially and the first and second detachable spur wheel segments are aligned coaxially.

3 Claims, 10 Drawing Sheets

U.S. PATENT DOCUMENTS

| | | | | | |
|---|---|---|---|---|---|
| 5,482,390 | A | | 1/1996 | Murakami et al. | 400/636.2 |
| 5,495,271 | A | | 2/1996 | Koitabashi et al. | 347/23 |
| 5,512,926 | A | | 4/1996 | Uchikata et al. | 347/86 |
| 5,524,994 | A | | 6/1996 | Hirano et al. | 400/579 |
| 5,534,898 | A | | 7/1996 | Kashino et al. | 347/33 |
| 5,534,899 | A | | 7/1996 | Uchikata et al. | 347/49 |
| 5,547,183 | A | | 8/1996 | Tamura | 400/55 |
| 5,595,382 | A | | 1/1997 | Arai | 271/122 |
| 5,606,357 | A | | 2/1997 | Bekki | 400/641 |
| 5,648,807 | A | * | 7/1997 | Saito et al. | 347/102 |
| 5,655,206 | A | | 8/1997 | Miyazawa | 399/361 |
| 5,670,997 | A | | 9/1997 | Sugimoto et al. | 347/30 |
| 5,671,000 | A | | 9/1997 | Hirabayashi et al. | 347/86 |
| 5,794,176 | A | | 8/1998 | Milillo | 364/559 |
| 6,059,280 | A | | 5/2000 | Yamauchi et al. | 271/272 |
| 6,089,773 | A | * | 7/2000 | Bailey et al. | 400/642 |

OTHER PUBLICATIONS

Application No. 08/250,678, filed May 26, 1994.
Application No. 08/470,155, filed Jun. 6, 1995.
Application No. 08/490,084, filed Jun. 13, 1995.
Application No. 08/789,603, filed Jan. 24, 1997.
Application No. 08/901,139, filed Jul. 28, 1997.
Application No. 09/002,383, filed Jan. 21, 1998.

* cited by examiner

| FIG. 8A |
| --- |
| FIG. 8B |
FIG. 8
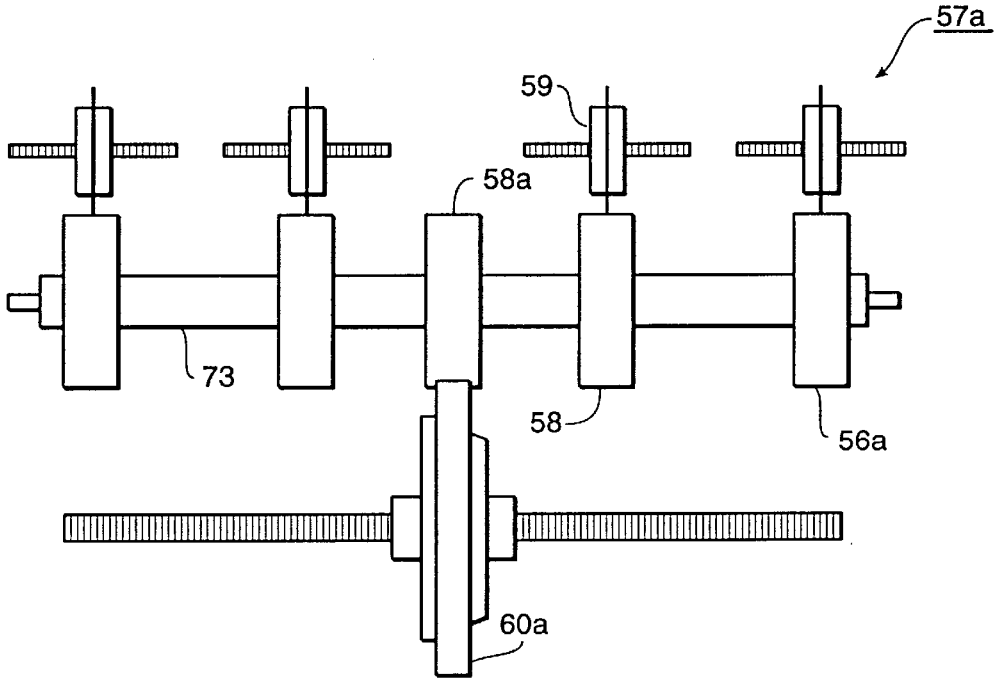
FIG. 8A
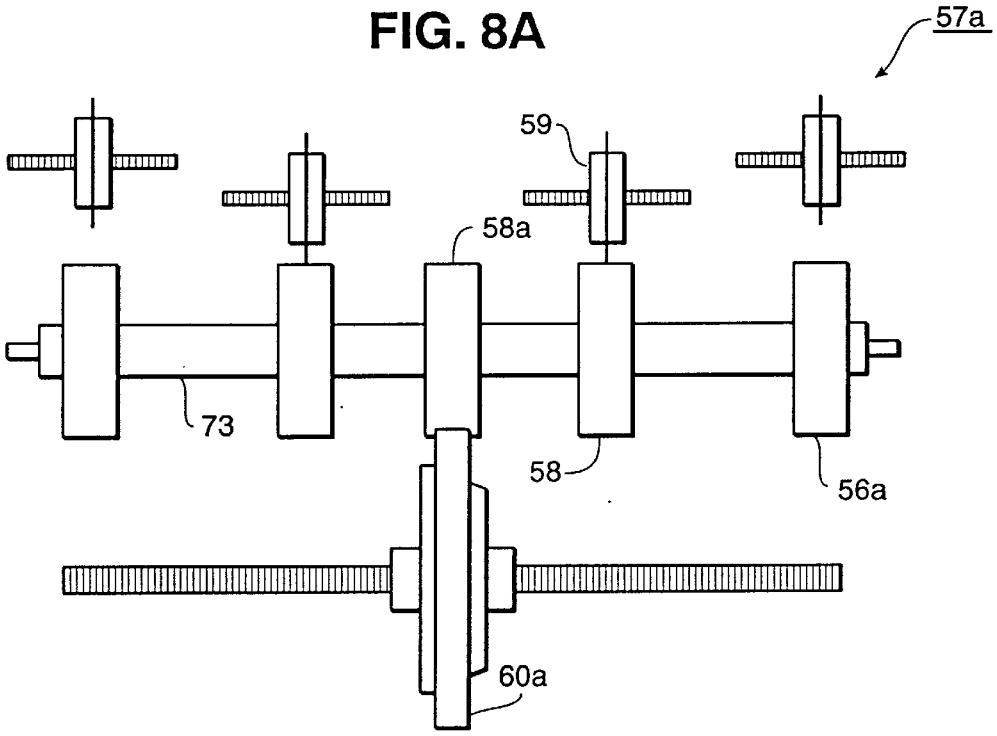
FIG. 8B

WIDE FORMAT PRINTER WITH DETACHABLE AND REPLACEABLE PAPER FEED UNIT COMPONENTS

This application is a continuation of U.S. patent application Ser. No. 09/019,190, filed Feb. 5, 1998, now U.S. Pat. No. 6,325,560 .

BACKGROUND OF THE INVENTION

1. Field of the Invention

The present invention relates to multi-head printers which have multiple printing modes, and particularly relates to multi-head printers which include a detachable and replaceable paper feed unit which accommodates both wide width printing and standard width printing, wherein the paper feed unit comprises replaceable components such as print roller sections, spur wheels, and friction wheels.

2. Description of the Related Art

Recently developed printers, such as multi-head ink jet printers are capable of printing across both a standard printing width for print media having standard widths such as 8½×11, legal, A4, etc., and a wide printing width for print media having a width greater than the standard width print media. However, because a majority of the printing performed at the office or at home is limited to standard width print media, the paper feed unit which comprises printer rollers, spur wheels, and friction wheel, wears more heavily along the standard width paper feed path resulting in uneven wear across the paper feed unit.

FIG. 1 illustrates diagrammatically components of a conventional paper feed unit 1. Shown in FIG. 1 are print roller 2, spur wheel 3, friction wheel 4 and drive roller 5, all of which are mounted and rotated along their center axis within the housing of the printer.

Upon performing a print job, recording material P is loaded into the printer and advanced by the printer into paper feed unit 1. Recording material 2 enters between printer roller 2 and spur wheel 3. Recording material P is advanced forward by the clockwise rotation of printer roller 2 and counterclockwise rotation of spur wheel 3. Printer roller 2 is rotated in a clockwise direction by friction roller 4, which is driven by drive roller 5. Spur wheel 3, while having no automatic drive system, is driven in the counter clockwise direction by the friction caused by spur wheel 3 pressing down on recording material P and print roller 2.

Due to the frictional contact between spur wheel 3 and recording material 2, over time the spur edge on spur wheel 3 becomes dull and rounded, and a paper dust is generated. As a result, the rounded spur edge tends to hold ink when feeding a high density printed paper causing a dotted line to be generated on the paper while feeding. Moreover, because the paper dust causes the spur wheel to slip when feeding, the image quality deteriorates and over time continuous paper feeding will contaminate printer roller 2 with paper dust. Typically, only the spur edges on the spur wheels which service the standard width paper feeding path wear, dull and become rounded since standard width recording media is used more frequently and since paper will round and dull the spur edges faster than spur edges contacting its opposing print roller. Therefore, because standard width print media is used more frequently, spur wheels along the standard width paper feed path will wear quicker than spur wheels which service the additional width of the paper feed path.

As explained above, the overall wearing of these components of the paper feed unit is unevenly distributed across the paper feed unit due to a portion of the paper feed unit being used predominantly for feeding standard width print media. This results in improper paper transmissions through the printer which may cause paper jams as well as improper printing quality due to possible buckling of the paper as it is fed through the unevenly worn paper feed unit 1.

Heretofore, it has not been possible to replace worn components or sections of the paper feed unit especially those components which are predominantly used for standard width printing without having to replace unworn components or sections of the paper feed unit or the entire unit itself. Accordingly, it is desirable to detach and replace only certain worn components or sections of the paper feed unit thereby reducing the overall costs of refurbishing the printer.

SUMMARY OF THE INVENTION

It is an object of the invention to provide detachable and replaceable components and sections which make up a paper feed unit of a printer such that only those components and section which have become worn over time can replaced without having to replace the unworn components and sections.

According to one aspect, the present invention is a printer having standard width and wide width printing capabilities. The printer includes feed means for feeding print media having either a standard width or wide width format, the feed means feeds the print media through a paper path past a print position, feed means including a first roller segment and a second roller segment aligned coaxially with each other and extending laterally across a printing width area of the printer, wherein the first roller segment has a feed width corresponding to standard width print media and the second roller segment has a feed width corresponding to an additional width of print media which extends beyond the standard width print media, both the first and second roller segments being detachably mounted within the printer.

According to another aspect, the present invention is a wide-width format printer having detachable and replaceable paper feed unit components which includes an automatic sheet feeder having a feeding width corresponding to standard width print media, a manual sheet feeder having a feeding width corresponding to standard width print media plus an additional width, paper feed unit for feeding print media fed from either the automatic sheet feeder or the manual sheet feeder through a paper path which passes a print position to a media ejection portion, the paper feed unit comprising at least first and second detachable print roller sections, first and second detachable spur wheel sections, at least two detachable friction wheels and a drive roller, wherein the first detachable print roller section and spur wheel section oppose each other, the second detachable print roller section and spur wheel section oppose each other and wherein the first and second detachable printer roller segments are aligned coaxially and the first and second detachable spur wheel segments are aligned coaxially.

BRIEF DESCRIPTION OF THE DRAWINGS

FIG. 7, comprising

FIG. 8, comprising FIGS. 8*a* and 8*b*, illustrates a first arrangement of spur wheels in a spur wheel section shown in FIGS. 7*a* and 7*b* and a second arrangement of spur wheels in a spur wheel section shown in FIGS. 7*a* and 7*b*.

DETAILED DESCRIPTION OF THE PREFERRED EMBODIMENT

Figure 1:
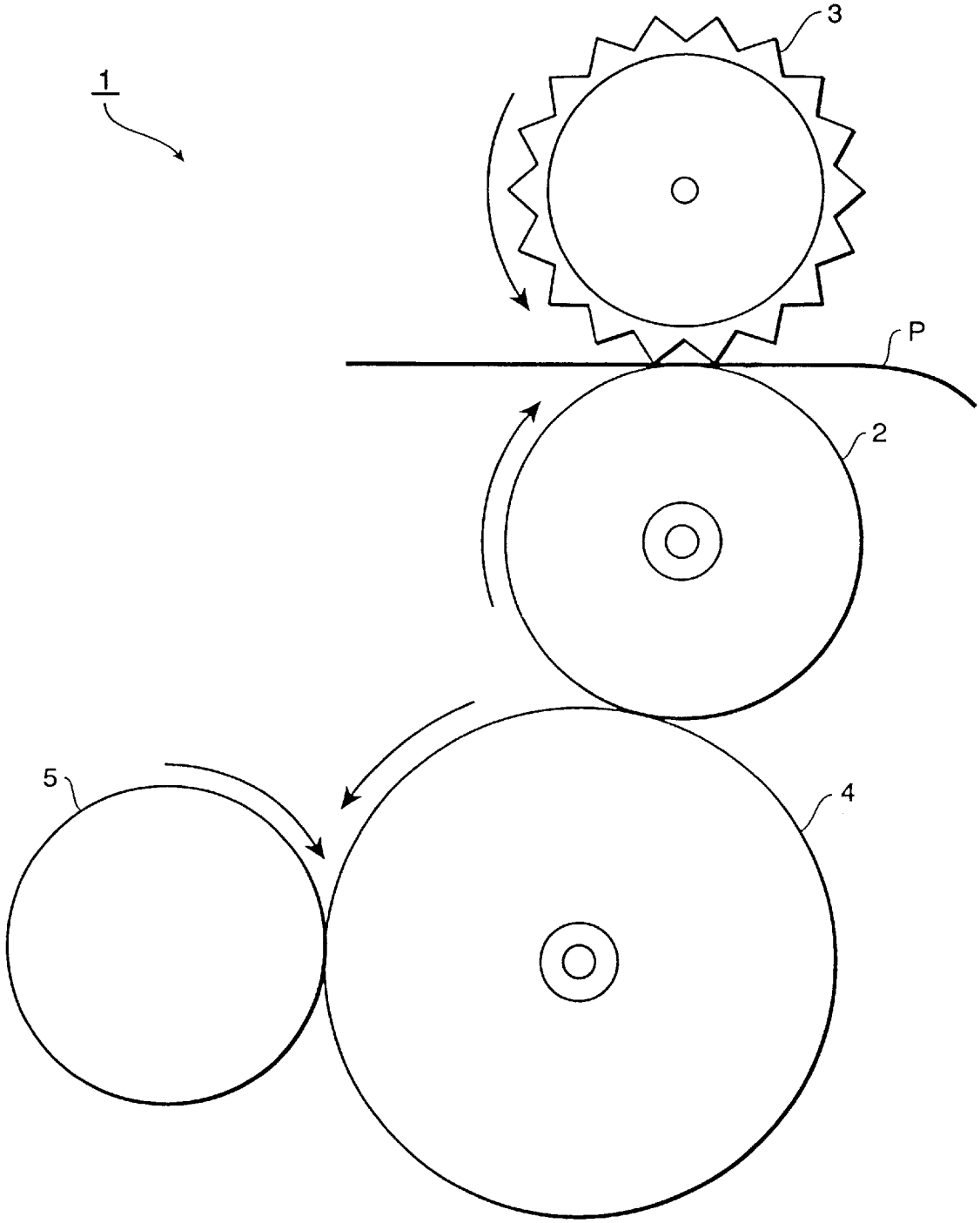
FIG. 1 PRIOR ART
FIG. 1 illustrates diagrammatically a conventional paper feed unit of a printer.
Figure 2:
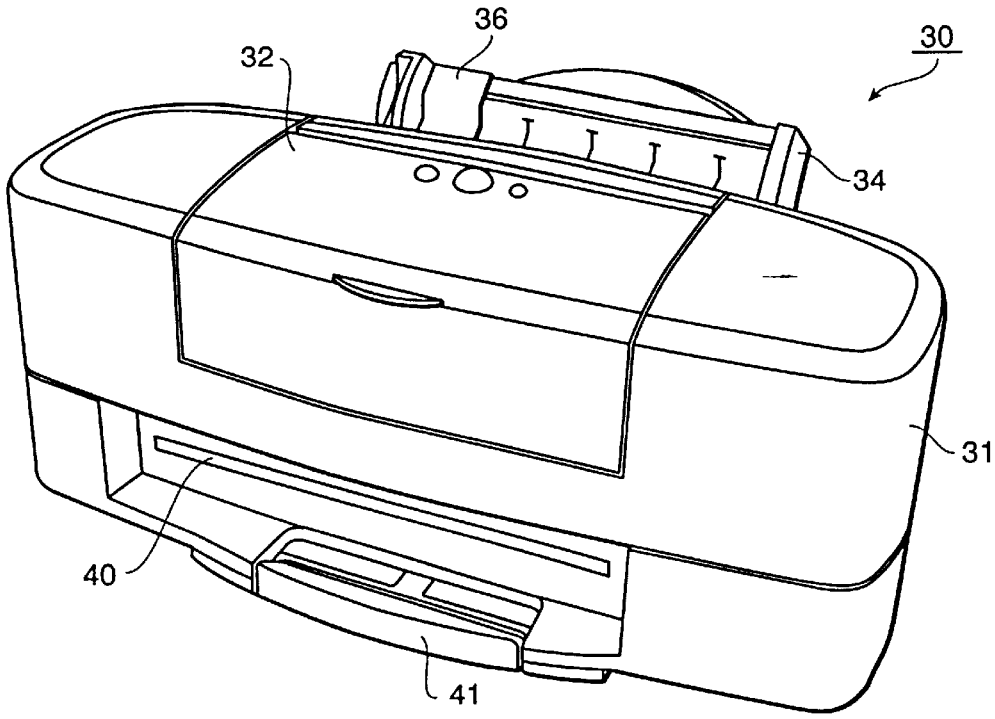
FIG. 2 is a front perspective view of the printer of the present invention.

As shown in FIG. 2, the present invention resides in printer 30. In preferred embodiments of the invention, printer 30 is a multiple-head serial printer. Accordingly, although the invention described herein are not limited to use with such a printer, the invention will be described in the context of such a printer.

Figure 3:
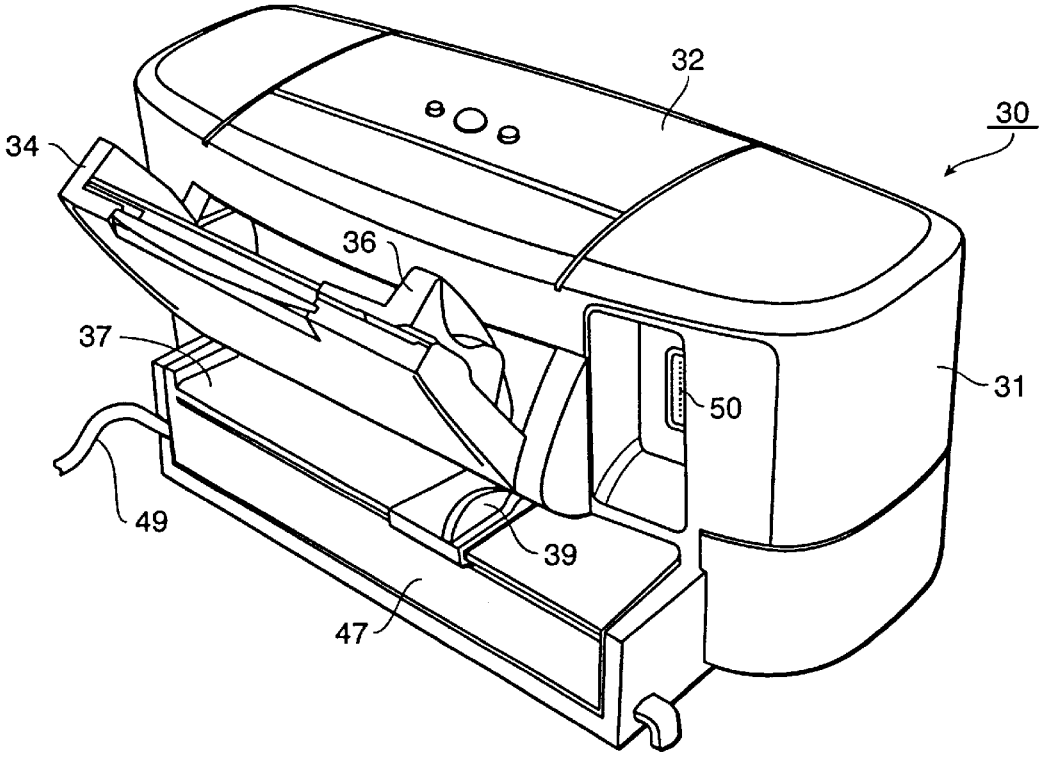
FIG. 3 is a back perspective view of the printer shown in FIG. 2.

In this regard, FIGS. 2 and 3 show close-up perspective front and back views, respectively, of printer 30. As shown in these figures, printer 30 includes housing 31, access door 32, automatic feeder 34, automatic feed adjuster 36, manual feeder 37, manual feed adjuster 39, media eject port 40, ejection tray 41, power supply 47, power cord 49, and parallel port connector 50.

Housing 31 is approximately 498 mm in width by 271 mm in depth by 219 mm in height and houses the internal workings of printer 30, including the paper feed unit described below, which feeds the paper from either automatic feeder 34 or manual feeder 37 out through media eject port 40. Included on housing 31 is access door 32. Access door 32 is manually openable and closeable so as to permit a user to access the internal workings of printer 30 and, in particular, to access print cartridges, the paper and the paper feed unit installed in printer 30.

As shown in FIGS. 2 and 3, automatic feeder 34 is also included on housing 31 and printer 30. Automatic feeder 34 defines a media feed portion of printer 30. That is, automatic feeder 34 stores recording media onto which printer 30 prints images. In this regard, printer 30 is able to print images on a variety of types of recording media. These types include, but are not limited to, plain paper, high resolution paper, transparency, glossy paper, glossy film, back print film, fabric sheets, t-shirt transfers, bubble-jet paper, greeting cards, brochure paper, banner paper, thick paper, etc.

Automatic feeder 34 is able to accommodate a recording media stack which is approximately 13 mm thick. This means that the automatic feeder 34 can hold, e.g., approximately 130 sheets of paper having a density of 64 g/m$^2$ or approximately 15 envelopes. When printing, individual sheets which are stacked within automatic feeder 34 are fed from automatic feeder through print 30. Specifically, the paper feed unit (to be described below), which comprises a drive roller, line feed motor, friction wheels, printer rollers, spur wheels and necessary gears, draws individual media from automatic feeder 34 into printer 30. These individual media are then fed in a paper feed path through the rollers to eject port 40 shown in FIG. 2.

Automatic feed 34 includes automatic feed adjuster 36. Automatic feed adjuster 36 is laterally movable to accommodate different media sizes up to a standard paper width within automatic feeder 34.

Individual sheets also can be fed through printer 30 via manual feeder 37 shown in FIG. 3, which also defines a media feed portion of printer 30. In preferred embodiments, manual feeder 37 can accommodate media having a density of at least between 64 g/m$^2$ and 550 g/m$^2$, and having a thickness of 0.8 mm. Sheets fed through manual feeder 37 are fed straight through the rollers in printer 30 to eject port 40. As was the case with automatic feeder 34, manual feeder 37 includes manual feed adjuster 39 which can accommodate both standard width papers as well as widths greater than the standard width. By sliding manual feed adjuster 39 laterally, a user can vary the media which manual feeder 37 can accommodate.

Using manual feeder 37 and automatic feeder 34, printer 30 can print images on media having a variety of different sizes. These sizes include, but are not limited to, letter, legal, A4, A3, A5, B4, B5, tabloid, No. 10 envelopes, DL envelopes, banner, wide banner, and LTR full bleed. Custom size recording media can also be used with printer 30.

Power cord 49 connects print 30 to an external IC power source. Power supply 47 is used to convert AC power from the external power source and to supply the converted power to printer 30. Parallel port 50 connects printer 30 to a host processor (not shown). Parallel port 50 preferably comprises an IEEE-1284 bi-directional port, over which data and commands are transmitted between printer 30 and the host processor.

Figure 4:
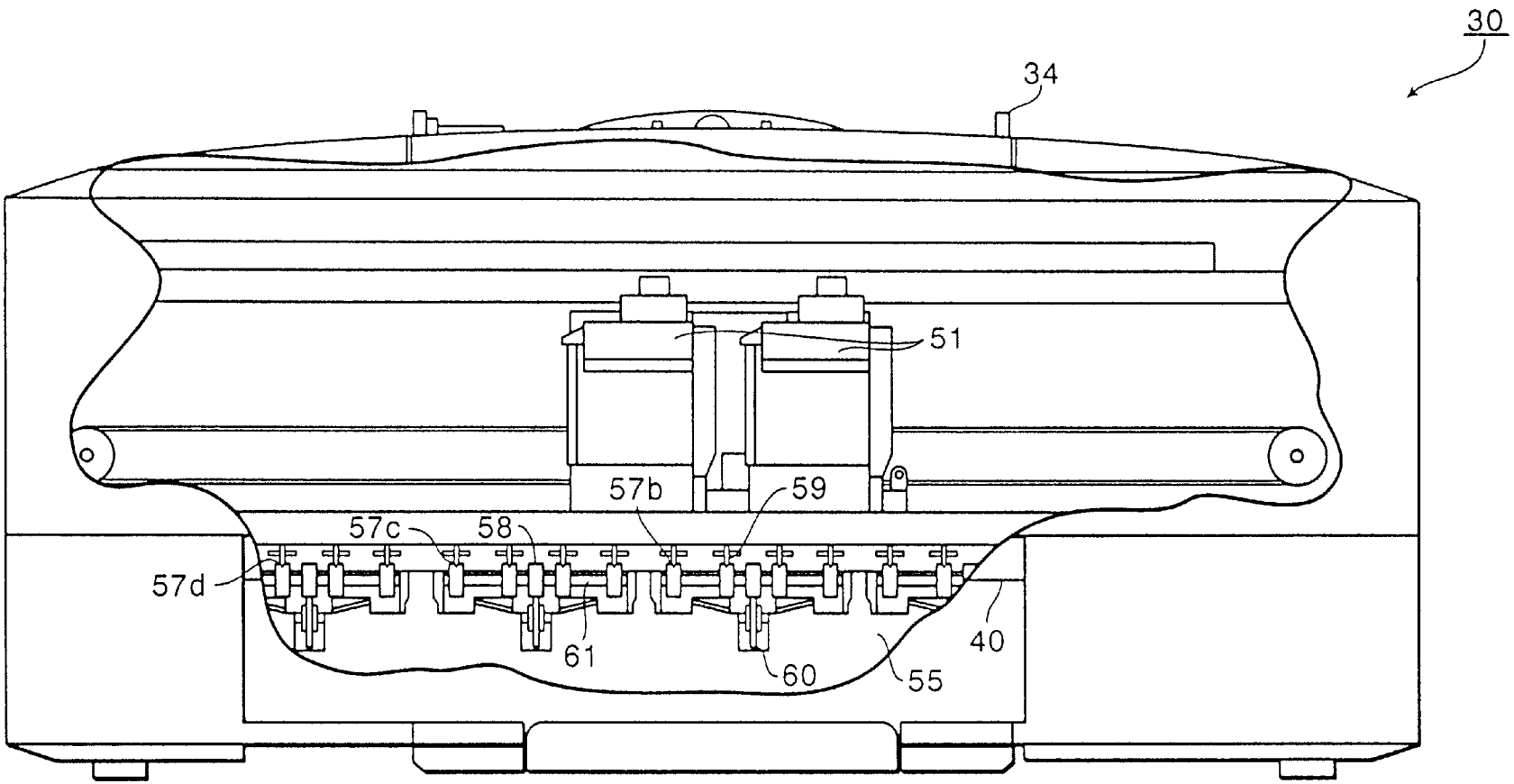
FIG. 4 is a front cut-away perspective view of the printer shown in FIG. 2.

As shown in FIG. 4, printer 30 is a dual cartridge printer which prints images using two print heads 51 (i.e., one head per cartridge). Recording medium P is transported beneath print heads 51 so that an image can be printed onto recording medium P as paper fed under print heads 51 by paper feed unit 55. Paper feed unit 55 draws recording medium P out through media eject port 40. In this regard, recording medium P can be transported from either automatic feeder 34 or manual feeder 37 through printer 30 to media eject port 40.

Paper feed unit 55 pulls the front edge of recording medium P by drawing the recording medium across printer roller sections 56*a*–56*d* (see FIG. 5) and spur wheel sections 57*a*–57*d* (57*a* is not shown in FIG. 4). In this regard, printer roller sections 56*a*–56*d* and spur wheel sections 57*a*–57*d* are arranged in four opposing and corresponding sections. Each section of printer rollers includes five print rollers 58 mounted on a single axle. Each spur wheel section includes four spur wheels 59, each of which oppose a print roller, with the exception of the middle print roller. Printer roller sections 56*a*–56*c* and spur wheel sections 57*a*–57*c* are together dimensioned to feed standard width print media, while print roller section 56*d* and corresponding spur wheel section 57*d* are used only for the additional width of print media when using wide width print media passed through manual sheet feeder 37. In this regard, printer roller section 56*d* is dimensioned to serve only the wide width paper path of manual sheet feeder 37. Because wide width paper is not typically used, print roller section 56*d*, spur wheel section 57*d* and friction wheel 60*d* do not wear out as quickly as the remaining print roller and spur wheel sections.

As will be discussed below in greater detail, each printer roller section 56*a*–56*d* has a width which is almost equal to the distance (2.4 inches) between the print heads of print heads 51 in printer 30. In this fashion, printer 30 is set up so that the additional width of print media will be printed by only the left side print head of print heads 51 thereby providing the smallest width necessary for printing on wide with print media.

Because the standard width paper path is used more frequent than the additional width paper path, printer roller section 56*d* does not need to be replaced as frequently. Therefore, each printer roller section 56*a*–56*c* is designed to be replaced separately from printer roller section 56*d*.

Each printer roller section 56*a*–56*d* is driven by a corresponding frictional roller 60*a*–60*d* which, in turn, is driven by a drive roller (not shown in FIG. 4).

For the purposes of brevity and because all print roller sections, spur wheel sections and friction wheels are identical, the remaining discussions will be directed to print roller section 56*a*, spur wheel section 57*a* and friction wheel 60*a*.

In operation, friction roller 60*a* is driven by the drive roller (not shown) in a counterclockwise direction. Friction roller 60*a* contacts print wheel 58*a* of print roller section 56*a* so as to drive printer roller section 56*a* in a clockwise direction. Recording media P is drawn forward through media eject port 40 when the leading edge of recording media P comes into contact on its topside by each spur wheel 59 of spur wheel section 57*a* and on its underside by each print wheel of printer roller section 56*a*. For standard width print media, only printer roller sections 56*a*–56*c* and spur units 57*a*–57*c* are used.

Figure 5:
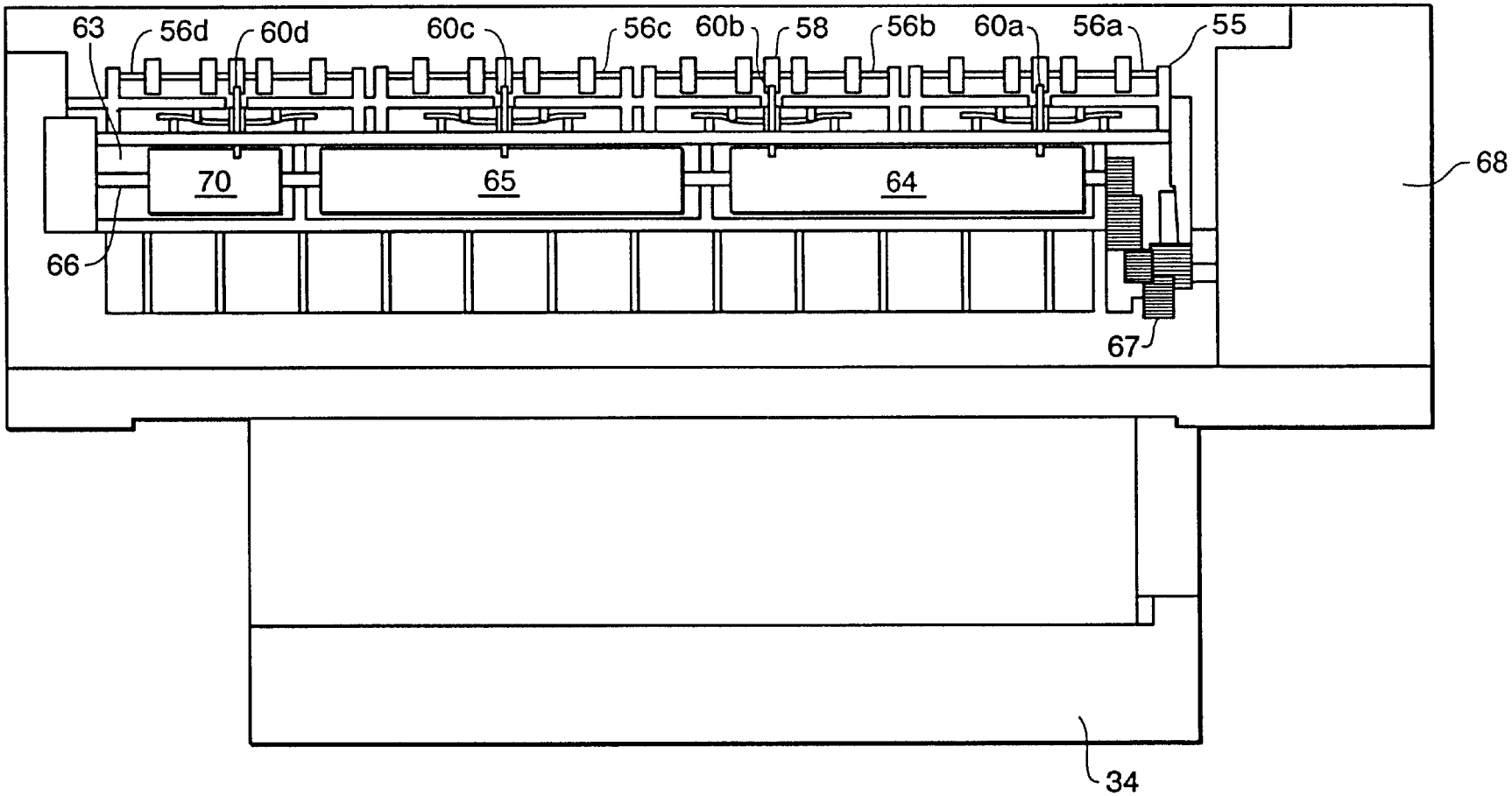
FIG. 5 is an underside view of the paper feed unit of the present invention.

FIG. 5 is an underside view of paper feed unit 55. As shown in FIG. 5, each friction roller 60*a*–60*d*, for each respective printer roller section 56*a*–56*d*, contacts a portion of drive roller 63. Drive roller 63 comprise three separate print drive rollers 64, 65 and 70 mounted on steel spindle 66. Steel spindle 66 is rotatably mounted on one end to the housing of printer 30 and on the other end connected to gear system 67. Gear system 67 are in turn geared into line feed motor 68 (not shown) which controls the rotation of drive roller 63. Line feed motor is controlled so as to feed print media through paper feed unit 55 at 120 mm/sec.

Print drive rollers 64 and 65 drive printer roller sections 56*a*, 56*b* and 56*c*. This combination of print drive rollers 64 and 65 and printer rollers 56*a*, 56*b* and 56*c* provide the paper feeding for automatic sheet feeder 34 such that all standard width media are pulled through this combination of rollers and wheels.

Print drive roller 70 provides the rotational movement for friction wheel 60*d* which contacts print roller section 56*d*. Print drive roller 70 and printer roller section 56*d* are positioned at the wide-side of printer 30's printable area. Together with printer roller sections 56*d* and spur wheel section 57*d*, the remaining printer roller sections and spur wheel sections transport wide width media from manual sheet feeder 37 to media eject port 40.

Figure 6:
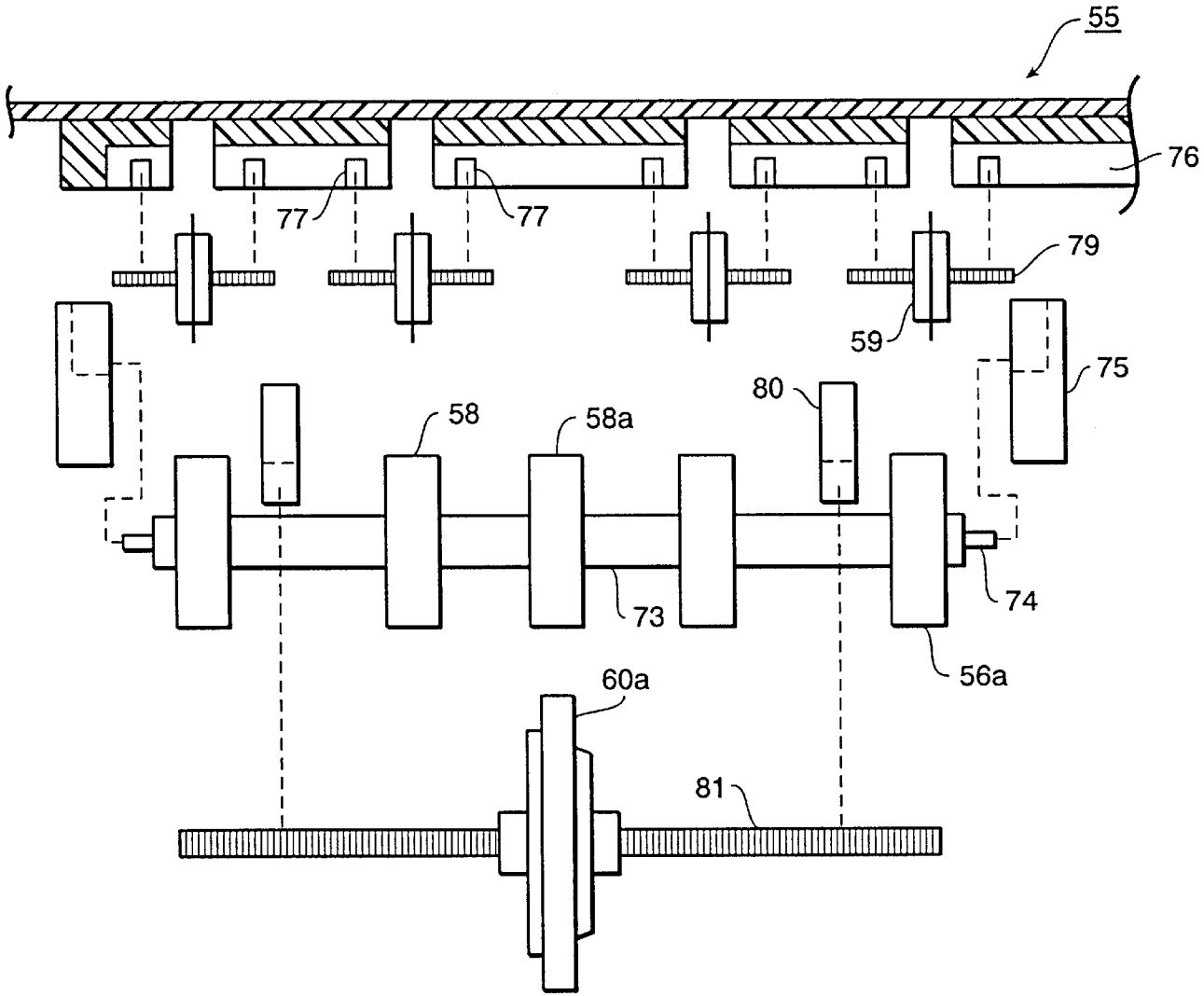
FIG. 6 is an exploded view of a section of the paper feed unit shown in FIG. 5.

FIG. 6 shows an exploded view of a section of paper feed unit 55. As shown in FIG. 6, printer roller section 56*a* includes individual print rollers 72 which are made from a rubber material. In each printer roller section 56*a*–56*d*, there are five individual print rollers 58 which are mounted on axle 73. At each end of axle 73, there is located mounting pin 74. Mounting pins 74 are detachably mounted within mount 75 by either slidably engaging mount pins within mount 75 or by snapping mount pins into clasps (not shown) in mount 75. In either case, mount pins 74, once mounted, remain free to rotate within mount 75 so as to permit print roller section 56*a* to freely rotate. In this regard, mount 75 may include means for slidably engaging within a cut-out section of mount 73 (not shown) so as to rotatably retain mounting pins 74 within mount 75.

As mentioned above, because mount pins 74 are detachably mounted, print roller section 56*a* may be easily detached and replaced once one or more of print roller 58 becomes worn. Typically, print roller sections 56*a*–56*c*, which serve both standard and wide with print media, wear out faster than print roller section 56*d* which is only sized to service the width, which extends beyond standard width print media, of wide width print media. Because the print roller sections for servicing the standard width print media can be individually detached and replaced, print roller section 56*d* need not be replaced if not worn.

For each printer roller section 56*a*–56*d*, there is an opposing spur wheel for each print roller 58 with the exception of the middle print roller 58*a* which is in frictional contact with friction wheel 60*a*. Each spur wheel 59 is retained in retaining house 76 by its spring axle 79 which is retained by clasps or some other means within retaining house 76. In a preferred embodiment, retaining house 76 includes retaining clasps 77 which detachably hold each end of spring axle 79 of spur wheel 59. In this fashion, spur wheel 59 can freely rotate around spring axle 79 while spring axle 79 is prevented from rotating by clasps 77. Because spur wheel 59 is mounted on spring axle 79, it is free to move both upward and downward against its opposing print roller of each print roller section 56*a*–56*d*. In this manner, when print media of varying thickness is introduced between a spur wheel and its opposing print roller, spur wheel 59 may move upward or downward against the print media so as to accommodate its thickness and so as to remain in contact with the print media while also providing a downward force against print roller 72.

Because spring axle 79 is detachably retained within retaining house 76, each spur wheel 59 can be easily replaced by detaching spring axle 79 from clasps 77 within retaining house 76. As a result, when spurs on one or more of spur wheels 59 have become worn or rounded, each worn spur wheel may be individually replaced. Typically, each spur wheel 59 is replaced at the same time that one or more print roller sections are replaced.

In a similar fashion, friction wheel 60*a* is detachably received within anchor 80. Anchor 80 allows spring axle 81 to be anchored within anchor 80 so as to permit friction wheel 60*a* to rotate around anchored spring axle 81 much in the same manner as spur wheel 59 rotates freely on spring axle 79. As in the case with printer roller 56*a* and spur wheel 59, friction wheel 60*a* is easily detachable for replacement during servicing.

In the preferred embodiment of the present invention, each of the individual printer roller sections, spur wheels and friction wheels can be detached and individually replaced, if necessary.

Figure 7A:
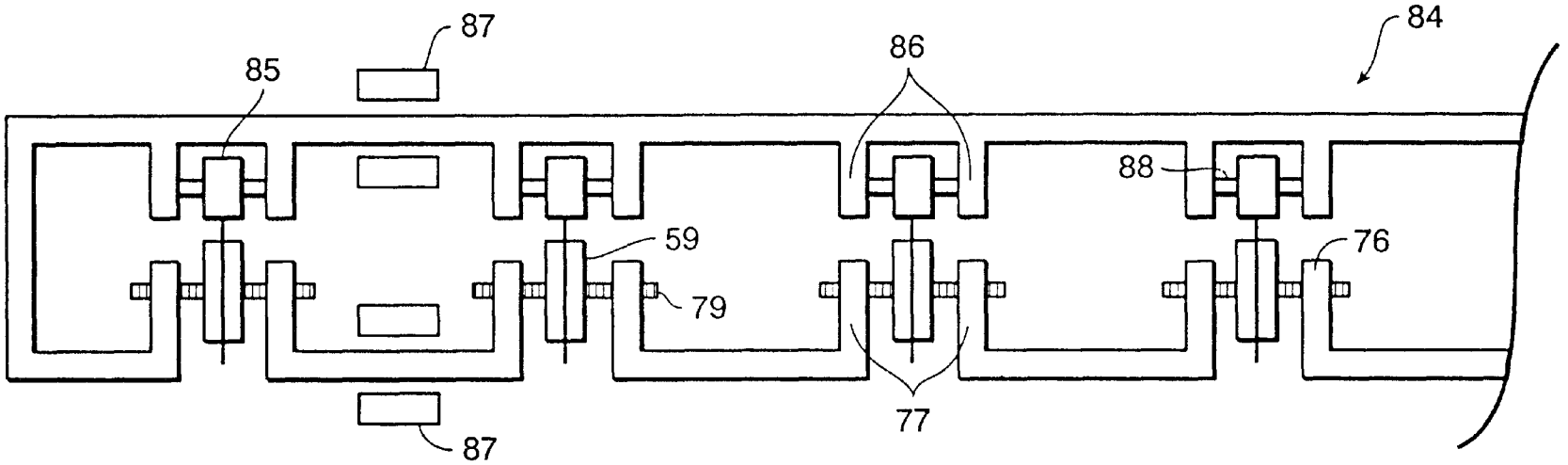
FIGS. 7*a* and 7*b*, illustrates a first embodiment of a spur wheel section and an alternative embodiment of a spur wheel section of the paper feed unit of the present invention.

FIG. 7*a* shows mounting system 84 for mounting spur wheels 59 within printer 30. As shown in FIG. 7*a*, spring axles 77 of spur wheels 59 are mounted within retaining housings 76. As stated previously, spring axles 79 are detachably mounted within housing 76 so as to spur wheels 59 to be detached and replaced while at the same time restricting rotation of spring axle 79

Mounting system 84 further includes guide wheels 85 which are in frictional contact with spur wheels 59. Guide wheels 85 are rotatably retained within housing 86 via axles 88. Guide wheels 85 maintain central alignment of spur wheels 59 while at the same time permitting spur wheels 59 to move upwardly or downwardly within retaining housing 76 in mounting system 84.

Although not shown in FIG. 7*a*, mounting system 84 runs the length of the printable area of printer 30 and has a one to one correspondence in length to printer roller sections 56*a*–56*d*, shown in FIG. 5. In this regard, printer roller sections 56*a*–56*d* also run the length of the printable area in printer 30.

Mounting system 84 is held in place in the housing of printer 30 by means of glue, clasps clamps, rivets, etc. In the preferred embodiment, mounting system 84 is made of a plastic material and is held in place within printer 30 by clasps 87 which are evenly distributed across the length of mounting system 84.

Figure 7B:
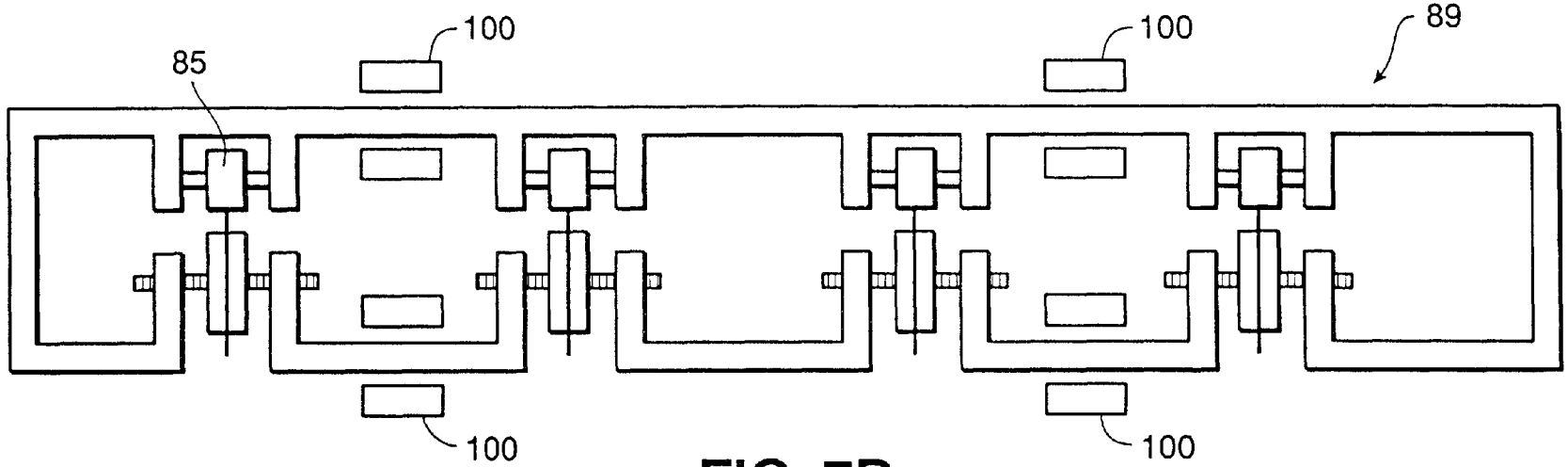

FIG. 7*b* depicts an alternative embodiment of mounting system 84. In FIG. 7*b*, the mounting system is reduced in size resulting in mounting unit 89 which accommodates four spur wheels 59 and their corresponding guide wheels 59. Mounting unit 89 is exactly the same as mounting system 84, except that mounting unit 89 is dimensioned to correspond to the length of a single print roller section. In this fashion, all four spur wheels for a single print roller section can be replaced rather than having to replace each of individual spur wheel 59 as is the case with mounting system 84, discussed above in FIG. 7*a*. In addition, mounting unit 89 is dimensioned so that only those units which service the standard width paper feed path can be replaced without having to replace the unit which services the wide side of the paper feed path. This results in time and cost savings when replacing components of the paper feed unit.

Mounting unit 89 is detachably secured in printer 30 by spring loaded clasps 100. As a result, mounting unit 89 can be quickly and easily replaced as an entire unit thereby saving costs and time. Although not shown, corresponding mounting units are provided for each printer roller section 56*a*–56*d*.

FIG. 8, comprising FIGS. 8*a* and 8*b*, illustrates preferred and alternative arrangements of spur wheels in each spur wheel section. As shown in FIG. 8*a*, each spur wheel 59 of spur wheel section 57*a* is in frictional contact with its opposing print roller 58. As discussed above, because each spur wheel 59 is mounted on its respective spring axle 79, it is free to move upward and downward against its opposing print roller which is in a fixed position. In this manner, when varying thickness print media are introduced between each spur wheel and its opposing print roller, each spur wheel will move upward or downward against the print media so as to accommodate its thickness and so as to remain in frictional contact with the print media, regardless of its thickness, while also providing a downward force against its opposing print roller.

FIG. 8*b* shows an alternative embodiment of the spur wheel section described above. In FIG. 8*b*, the outer spur wheels rotate on axles which are rigid and do not permit flexing in any direction. The outer spur wheels are also positioned away from its corresponding print roller 58 such that the spatial relationship between the outer spur wheels and its opposing print roller equals the largest print media thickness which can be used with printer 30. Together with the two center spur wheels which are spring mounted, as described above, and which maintain contact with the print media regardless of its thickness, the spur wheel section shown in FIG. 8*b* maintain the print media on a proper paper feed path passed each print head and out through the media eject port.

Figure 9:
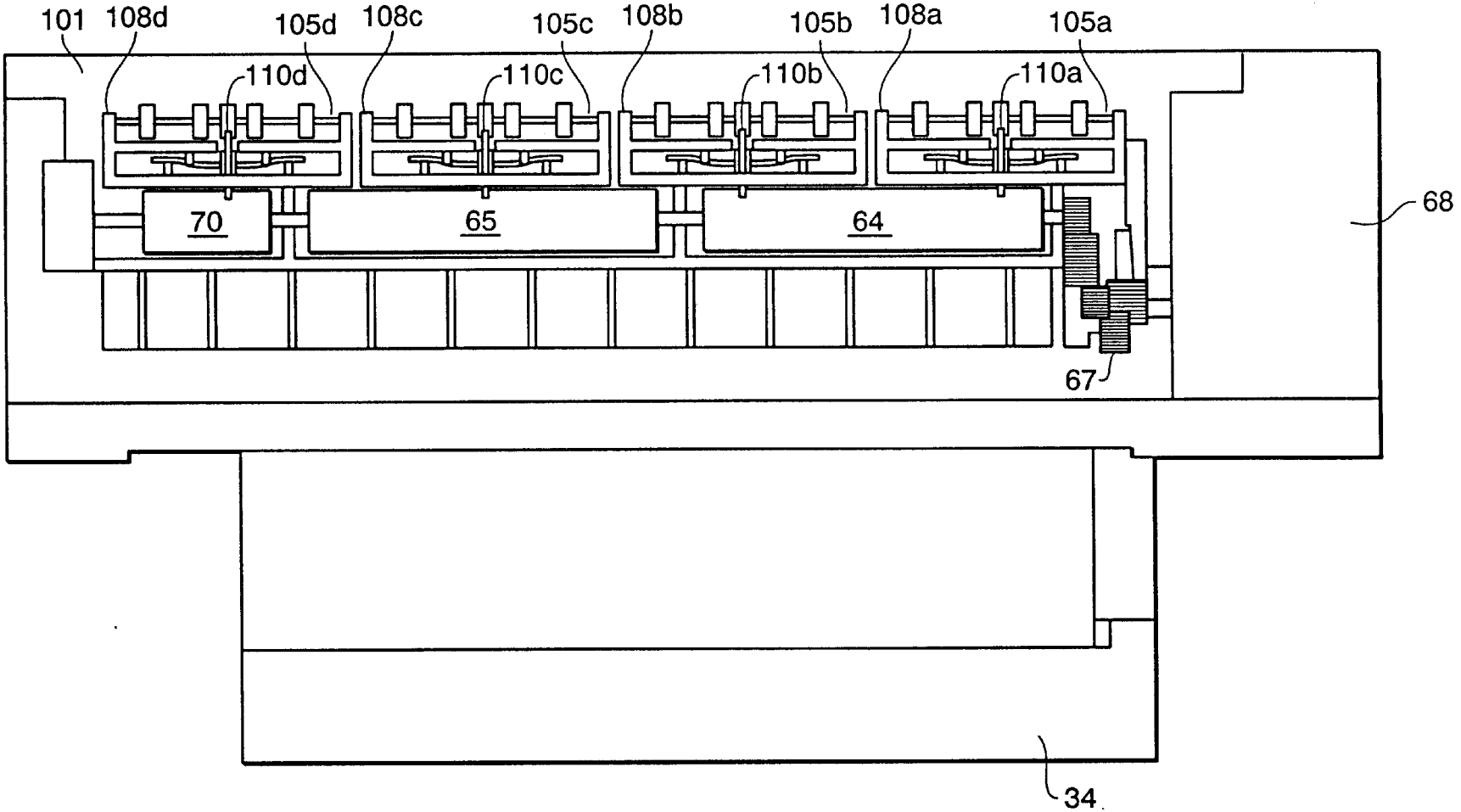
FIG. 9 is an underside view of an alternative embodiment of the paper feed unit having replaceable printer roller units which include a friction wheel in each unit.

FIG. 9 is an alternative embodiment of paper feed unit 55 shown in FIG. 5. As shown in FIG. 8, there is depicted an underside of paper feed unit 101. In this alternative embodiment shown FIG. 8, each printer roller section 105*a*–105*d* and its respective friction roller 110*a*–110*d* is coupled together in a single roller unit 108*a*–108*d*. Each roller unit 108*a*–108*d* is detachably secured within the housing of printer 30 by either means of tabs, clamps or slides. Roller units 108*a*–108*d* are each dimensioned so that roller unit 108*d* only services the wide side of the paper feed path.

Figure 10:
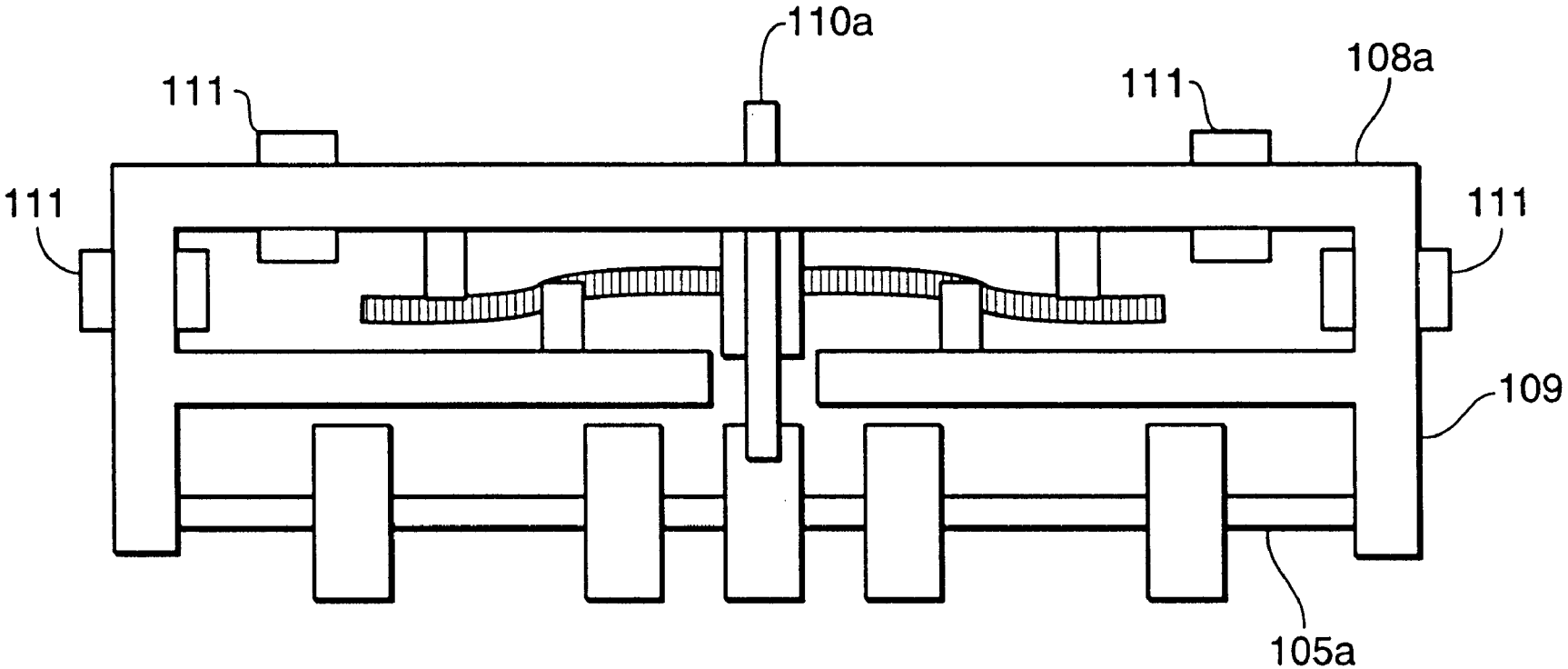
FIG. 10 is a close-up view of one of the printer roller units shown in FIG. 9.

FIG. 10 is a close-up view of roller unit 108*a*. Roller unit 108*a* comprises mounting structure 109 into which is mounted printer roller 105*a* and friction wheel 110. The design and structure of printer roller 105*a* and friction roller 110*a* is exactly the same as printer roller section 56*a* and friction roller 60*a* and are mounted within mounting structure 109 much in the same fashion as discussed previously with respect to FIG. 6.

As a result of mounting printer roller 105*a* and friction wheel 110*a* within roller unit 108*a*, roller unit 108*a* can be conveniently and quickly detached and replaced in printer 30. In this regard, roller unit 108*a* is detachably mounted into the housing of printer 30 by spring clasps 111, which are evenly distributed around the periphery of mounting structure 109. Spring clasps 111 detachably retain roller unit 108*a* within the housing during operation.

Alternatively, roller units 108*a*–108*c* may be one entire unit which services the standard paper path while roller unit 108*d* is a single unit by itself which services the additional width of print media which extends beyond the standard width paper path. In this manner, the single roller unit comprising roller units 108*a*–108*c* may be detached and replaced independent of roller unit 108*d*. The present invention may also be modified to permit each print roller on each roller unit 108*a*–108*d* to be individually replaceable, as necessary.

Reverting back to FIG. 9, roller units 108*a*–108*d* are mounted to the housing of printer 30 such that printer rollers 105*a*–105*d* have the same alignment as printer roller sections 56*a*–56*d* described above with respect to FIG. 5. In this fashion, each print roller aligns with its opposing spur wheel 59 whether the spur wheel is retained in a configuration shown in FIG. 7*a* or FIG. 7*b*. Moreover, each friction wheel 110*a*–110*d* of roller unit 108*a*–108*d* is aligned with its respective portion of driver roller 63, as discussed above with respect to friction wheels 60*a*–60*d*. To this end, when service is required to replace worn printer rollers and friction wheels, roller units 108*a*–108*c*, which wear faster due to the greater use of standard width print media, can be detached and replaced separately from roller unit 108*d* which only services the wide side of paper feed unit 101. Alternatively, roller unit 108*d* may be permanently fixed in printer 30 with only roller units 108*a*–108*c* being detachable. As mentioned above, if roller units 108*a*–108*d* are molded or coupled into a single unit, the task of replacing just the print rollers and friction wheels which service the standard width paper path becomes easier and less time consuming.

While roller units 108*a*–108*d* have been preferably described as being retained by spring clasps, each roller unit may be detachably retained by other means such as a slide mount, latch pin or hooks, etc. Moreover, while roller unit 108*a*–108*d* are preferably made from plastic, other sturdy types of materials may be substituted therefor, such as metal.

Figure 11:
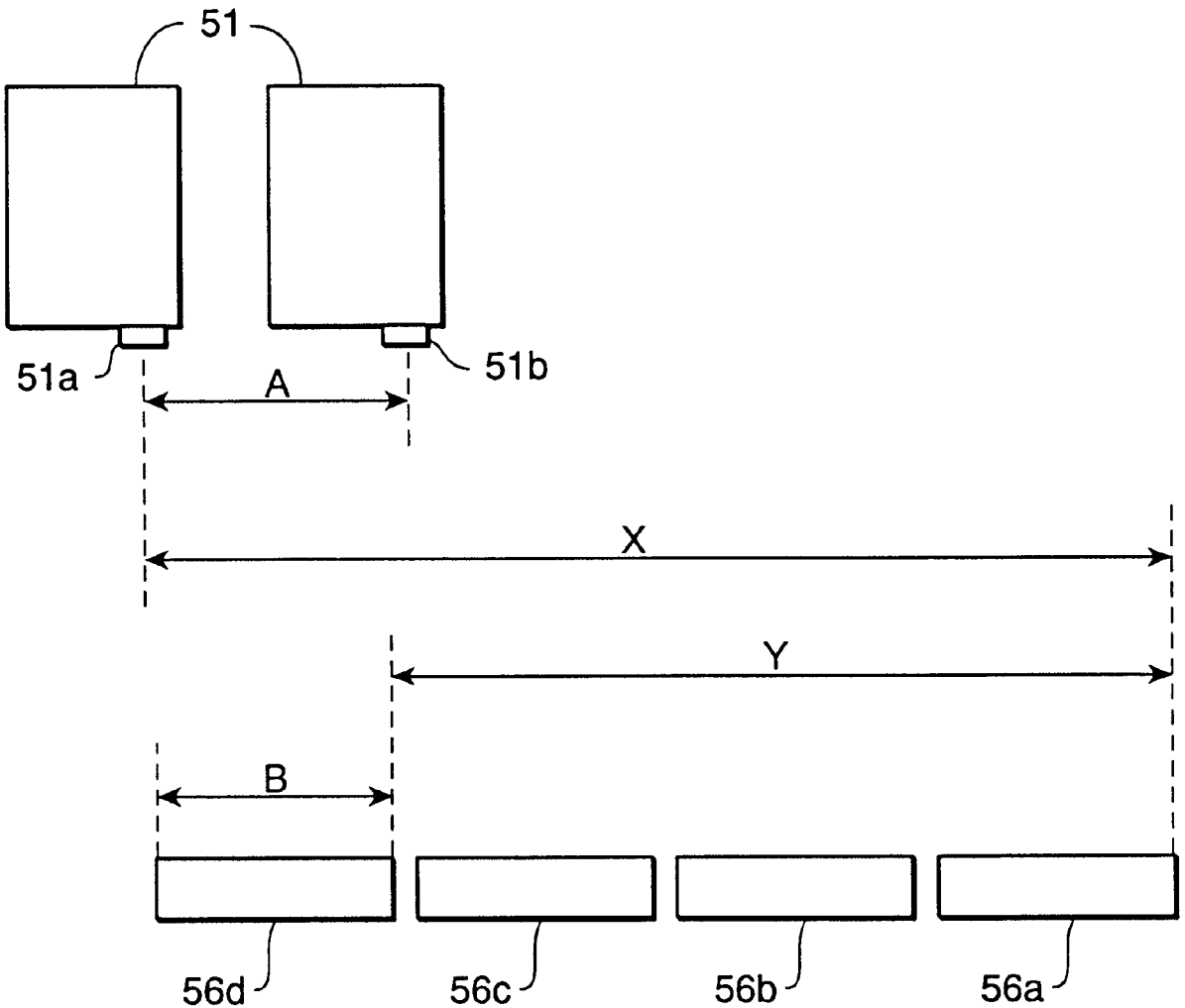
FIG. 11 shows the relationships between the wide width portion of the paper feed unit to the distance between print heads.

FIG. 11 shows the relationships between the wide width portion of the paper feed unit to the distance between print heads of print heads 51. As shown in FIG. 11, when printing on standard print media, print heads 51*a* and 51*b* are both capable of printing. Because two print heads are used within the standard width print area of the paper feed unit, high quality printing and high speed printing can be obtained. That is, since both print heads are used to print on standard width print media, the inks/dyes of the two printheads can be combined for high quality printing, for example, when printing photo-quality printing. In addition, it is possible to print at a high speed since both print heads can be used to print portions of the same scan line simultaneously. As a result, the standard width print area will be used more frequently to obtain either high quality printing or high speed printing.

However, when printing on wide width print media, only one print head, print head 51*a*, of print heads 51 is capable of printing in this area. Because only one print head can be used in the wide width portion of the paper feed unit, neither high quality printing nor high speed printing in the wide width area can be obtained for the reasons explained above with respect to two print head printing. As a result, the wide width area is used less frequently thereby causing less wear of the components which service the wide width portion of the paper feed unit. On the other hand, using only the left side print head, print head 51*a*, to print on the wide width area limits the width of printer 30. That is, in order to limit the width of printer 30, the distance A (2.4 inches) between printheads of print heads 51 is designed to be substantially equal to the additional width of wide width print media X. As a result, it is only necessary to use the left print head 51*a* for printing in the additional width area.

In order to limit the width of printer 30 to the smallest width necessary to print on wide width print media, print roller sections 56*a*–56*d* are dimensioned to be almost equal to or smaller than distance A between print heads 51*a* and 51*b*. Similarly, although not shown, roller units 108*a*–108*d* and mounting units 89 are each dimensioned to have a width which is almost equal to or less than the distance A between printheads 51*a* and 51*b*. In this fashion, the least width necessary for printing wide width print media in printer 30 will be used while not increasing the width of printer 30.

What is claimed is:

1. A printer for printing an image on either a first print media having first width or a second print media having second width that is larger than said first width, comprising:

feed means for feeding either the first print media or the second print media, said feed means feeding either the first or second print media through a paper path past a print position, said feed means including a first roller unit and a second roller unit aligned coaxially with each other and extending across a width direction of said paper path, wherein said first roller unit has a first feed width corresponding to the first print media and said second roller unit has a second feed width corresponding to an additional width of the second print media which extends beyond the width of the first print media, wherein both the first and second roller units are detachably mounted within the printer, and wherein the first and second roller units each comprise an eject roller for ejecting the print media and a friction roller for transferring a driving force to the eject roller.

2. A printer according to claim 1, wherein the first and second roller units are detachably mounted within the printer such that said first roller unit is replaceable independent of said second roller unit.

3. A printer according to claim 1, further comprising an automatic sheet feeder for feeding the first print media and a manual sheet feeder for feeding the second print media.

* * * * *

UNITED STATES PATENT AND TRADEMARK OFFICE

CERTIFICATE OF CORRECTION

PATENT NO. : 6,626,596 B2
DATED : September 30, 2003
INVENTOR(S) : Hirabayashi et al.

It is certified that error appears in the above-identified patent and that said Letters Patent is hereby corrected as shown below:

Title page,
Item [56], References Cited, FOREIGN PATENT DOCUMENTS, "03193480" should read -- 3-193480 --.

Column 2,
Line 21, "can" should read -- can be --; and
Line 40, "includes" should read -- include --.

Column 3,
Line 12, "7b." should read -- 7b; --;
Line 20, "portion" should read -- portions --;
Line 24, "EMBODIMENT" should read -- EMBODIMENTS --; and
Line 28, "are" should read -- is --.

Column 4,
Line 55, "oppose" should read -- opposes --.

Column 5,
Line 8, "with" should read -- width --;
Line 36, "comprise" should read -- comprises --; and
Line 46, "provide" should read -- provides --.

Column 6,
Line 11, "wide with" should read -- wide width --.

Column 7,
Line 65, "maintain" should read -- maintains --; and
Line 66, "passed" should read -- past --.

UNITED STATES PATENT AND TRADEMARK OFFICE

CERTIFICATE OF CORRECTION

PATENT NO. : 6,626,596 B2
DATED : September 30, 2003
INVENTOR(S) : Hirabayashi et al.

It is certified that error appears in the above-identified patent and that said Letters Patent is hereby corrected as shown below:

Column 8,
Line 4, “shown” should read -- shown in --;
Lines 5, 12 and 15, “is” should read -- are --; and
Line 62, “roller unit” should read -- roller units --.

Signed and Sealed this

Eleventh Day of January, 2005

JON W. DUDAS
*Director of the United States Patent and Trademark Office*